US006435403B1

(12) United States Patent
Giblin et al.

(10) Patent No.: US 6,435,403 B1
(45) Date of Patent: Aug. 20, 2002

(54) DISPLAY CARTON

(75) Inventors: Edward John Giblin, Hopatcong, NJ (US); Robert Charles Blanc, College Point, NY (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/354,710

(22) Filed: Jul. 16, 1999

(51) Int. Cl.[7] ..... B65D 5/00

(52) U.S. Cl. ..... 229/164; 229/122; 229/117.28; 229/132.32; 229/122.33

(58) Field of Search ..... 229/200, 210, 229/236, 199, 123.2, 117.28, 164, 122.32, 122.33; 206/722, 773, 774, 746, 738

(56) References Cited

U.S. PATENT DOCUMENTS

| | | | | |
|---|---|---|---|---|
| 1,324,873 A | * | 12/1919 | Bovy | 229/117.28 X |
| 1,559,240 A | * | 10/1925 | Fox | 229/117.07 |
| 2,133,701 A | * | 10/1938 | Holmes et al. | 229/236 |
| 2,797,039 A | * | 6/1957 | Belsinger | 229/242 |
| 3,292,841 A | * | 12/1966 | Donovan | 229/123.2 |
| 3,756,502 A | * | 9/1973 | Swanson et al. | 229/242 |
| 3,891,137 A | * | 6/1975 | Ellison et al. | 229/164 |
| 4,184,625 A | * | 1/1980 | Stollberg et al. | 229/164 X |
| 4,382,504 A | | 5/1983 | Vesborg | |
| 4,907,693 A | * | 3/1990 | Child | 206/43.5 |
| 5,039,002 A | | 8/1991 | Spamer | |
| 5,277,360 A | | 1/1994 | DeMott | |
| 5,372,299 A | | 12/1994 | Edgerton et al. | |
| 5,657,872 A | | 8/1997 | Leftwich et al. | |
| 5,718,337 A | | 2/1998 | Carr et al. | |
| 5,791,555 A | * | 8/1998 | Kanter | 229/164 |
| 5,950,914 A | * | 9/1999 | Dunton et al. | 229/122 |
| 5,967,406 A | * | 10/1999 | Moorman | 229/120.37 |
| 6,328,202 B1 | | 12/2001 | Giblin | |

FOREIGN PATENT DOCUMENTS

| | | |
|---|---|---|
| DE | 7408256 | 6/1974 |
| EP | 0 799 770 A1 | 3/1997 |
| GB | 2 264 101 A | 8/1993 |

* cited by examiner

*Primary Examiner*—Lee Young
*Assistant Examiner*—Tri M. Mai
(74) *Attorney, Agent, or Firm*—Gerard J. McGowan, Jr.

(57) ABSTRACT

A shipping and display case or carton which is suitable for shipping and displaying consumer and other goods which are packaged in high unit volume. The display case enjoys excellent compressive strength so that the cases may be stacked one upon the other notwithstanding the substantial weight of the high unit volume consumer products, e.g. 300 fluid oz. heavy duty liquid detergent container. The display panel of the display case includes a bottom zone and lines of weakness on either side thereof. The bottom zone may be pulled downwardly to sever the lines of weakness and make it easier to slide the containers out of the display case. Moreover, the display panel also includes side zones which may be severed from the bottom closure of the display case and swung into positions in which they do not obstruct the egress of products from the display case.

9 Claims, 4 Drawing Sheets

DISPLAY CARTON

BACKGROUND OF THE INVENTION

Owing in part to the popularity of the so-called "club" stores, there is perceived to be an increase in consumer demand for products packaged in larger unit volumes. The demand for larger units has resulted in a need for suitable packaging for such units. Among the problems with which the packaging engineer must deal in devising suitable containers, is the increased weight which such containers must be capable of holding.

Increases in unit volume impact not only the immediate container for the product, but also secondary and tertiary packaging. For instance, cartons in which the larger/heavier containers are shipped must also be suitable and may have to be adapted to the new containers.

It is increasingly desirable to display containers in the same cartons or cases in which they are shipped. Such display cartons may in certain cases permit the elimination of the extra step of removal of the container from the carton and stacking it on a shelf. Therefore, a need exists not only for cartons or cases suitable for shipping the larger unit containers, but for cartons which are suitable both for shipping and for display of such containers. Because of the special problems which heavier containers tend to present, display cartons which may have been appropriate for smaller unit volume containers, may not be durable enough, strong enough, or convenient enough for use in connection with the larger unit volume products.

The Procter and Gamble Company uses a display carton for its 96 Load Tide® detergent product. The display carton includes four triangular corner posts and front and rear display windows wherein a portion of carton has been bent over and adhered to itself. This bent over portion constitutes an obstacle when it is desired to remove the heavy 96 Load containers from the display carton.

Ellison et al., U.S. Pat. No. 3,891,137 discloses a fiberboard container constructed from an outer blank of corrugated fiber board and a separate and distinct inner liner of corrugated fiberboard which is laminated interior thereof. A generally rectangular access door is located in one of the sidewall panels and is hinged to the remainder of the outer blank along an edge. An object of the Ellison et al. invention is said to be to provide a reinforced bulk container with an access door which does not substantially weaken the container. The cuts forming the access door in Ellison et al. are positioned at least two inches from the corners so as not to diminish the stacking strength. The width of access door 48 in FIGS. 3 and 4 of Ellison et al. may vary up to amount equal to the width of sidewall panel 32.

Vesborg, U.S. Pat. No. 4,382,504 is directed to a transport and display container.

Spamer, U.S. Pat. No. 5,039,002 is directed to a case for displaying articles in retail outlets, which is preferably formed of corrugated plastic or paperboard material.

DeMott, U.S. Pat. No. 5,277,360 is directed to a stackable container having a display opening. Locking slots and locking tabs are illustrated.

Edgerton et al., U.S. Pat. No. 5,372,299 is directed to a combined product shipping and display box.

Leftwich et al., U.S. Pat. No. 5,657,872 is directed to shipping/display container which includes a tray portion having a bottom panel, two opposed end panels and two opposed side panels. A front side panel includes a line of weakness defining a severable portion in at least an intermediate portion downward to the lower-most edge of the front side panel. The severable portion includes a preformed aperture located adjacent to the lower-most edge of the front panel for initiating removal of the severable region. It is said that because the severable portion, at least in its center region, is preferably completely removed down to the bottom panel, products may be extracted from the resulting opening even though other containers or articles may be stacked both above and below the subject container limiting the ability to extract packages at an angle.

Carr ett al., U.S. Pat. No. 5,718,337 discloses a carton for a bag stack. The carton includes two u-shaped upper edges defining access windows. The front and back walls are provided with a hinged or removable panel below the access window to allow the sizes of the front and back windows to be increased.

SUMMARY OF THE INVENTION

The present invention is directed to a shipping and display case or carton which is suitable for shipping and displaying consumer and other goods which are packaged in high unit volume. In particular, the display case of the invention enjoys excellent compressive strength so that the cases may be stacked one upon the other notwithstanding the substantial weight of the high unit volume consumer products, e.g. 300 fluid oz. heavy duty liquid detergent containers. In addition, the display window of the present display case can be increased in size to facilitate removal of heavy packages of consumer goods. The display panel of the display case includes a bottom zone and lines of weakness on either side thereof. The bottom zone may be pulled downwardly to sever the lines of weakness and make it easier to slide the containers out of the display case. Moreover, the display panel also includes side zones which may be severed from the bottom closure of the display case and swung into positions in which they do not obstruct the egress of products from the display case.

In a preferred embodiment, the display carton comprises four panels, a front display panel, an opposed rear panel, and two opposed side panels between the front and rear panels. The bottom closure preferably comprises two major flaps and two minor flaps. The display case advantageously includes a liner having liner walls adjacent the panels of the display case. Preferably the liner includes at least two liner walls, more preferably at least three liner walls and most preferably includes three liner walls and two partial liner walls, the partial liner walls corresponding substantially in dimension to the side zones of the front display panel.

In accordance with another advantageous feature of the invention, one or more of the walls of the liner include extensions, such as tabs, which are received within one or more apertures, such as slots, in the bottom closure. These serve to help secure the liner in the display carton. In addition, it is preferred that the sections of fiberboard in which the extensions of the liners are formed also be used to from liners. Such "nesting" saves paperboard and helps decrease the cost of the liner. Where such nesting is used, the top of the liner will include a cutout corresponding roughly to the shape of the extension.

For a more complete understanding of the above and other features and advantages of the invention, reference should be made to the following detailed description of the preferred embodiments and the accompanying drawings.

DETAILED DESCRIPTION OF THE INVENTION

Figure 1:
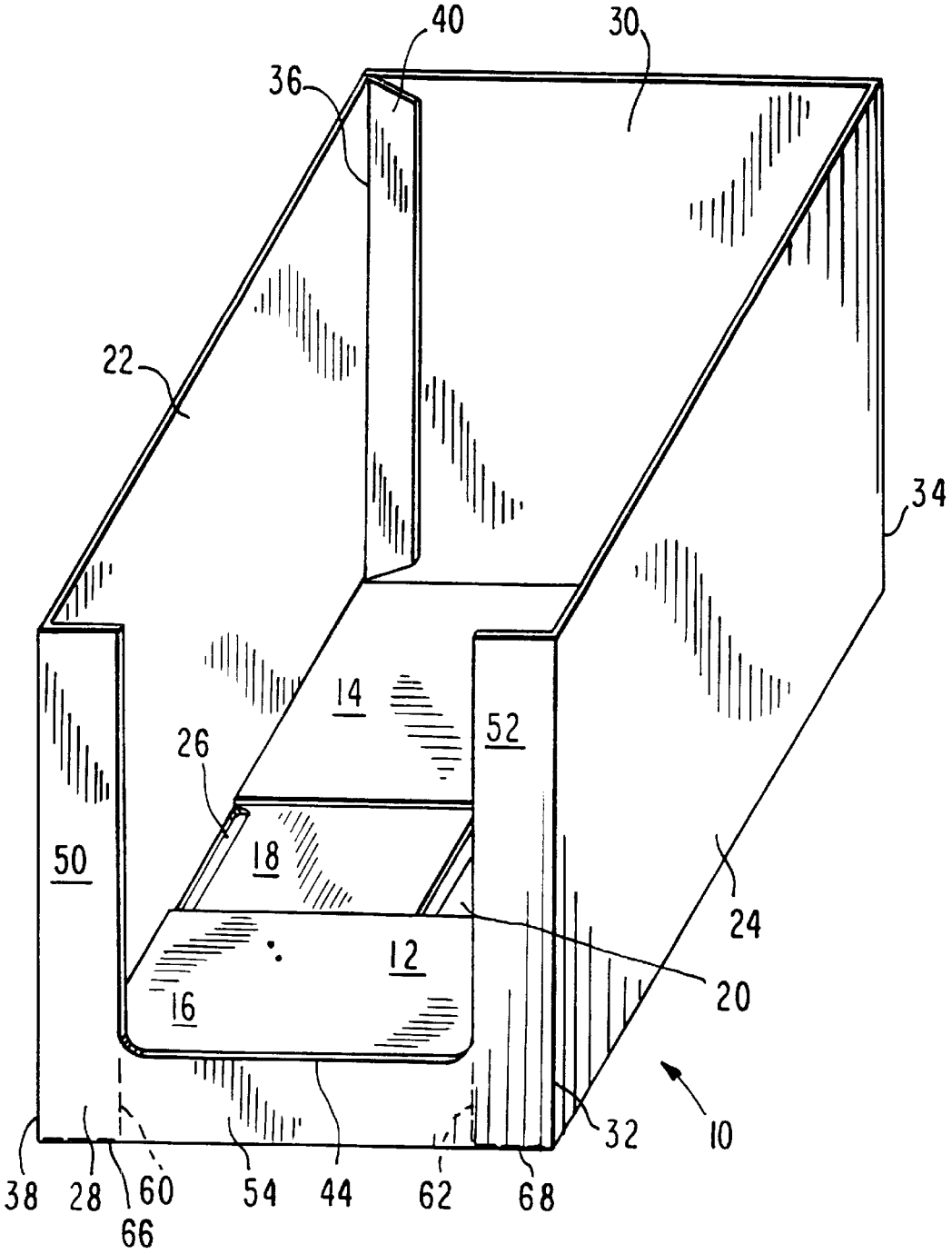
FIG. 1 is a perspective view of a shipping and display carton according to the invention.

Carton 10 (FIG. 1) comprises bottom closure 12 which includes minor flaps 14 and 16 and underlying major flaps 18 and 20.

Extending upwardly from major closure flaps 18 and 20, respectively, are first and second side panels 22 and 24. Medial to the intersections of bottom closure panels 18, 20 with side panel 22, 24 are disposed slots 26, 28. Extending upwardly from minor flaps 16 and 14 are, respectively, front display panel 28 and rear panel 30. Panels 22, 28, 24 and 30 are separated from each other respectively by fold lines 38, 32, and 34, respectively. Separated from first side panel 22 by scoreline 36 is glue flap 40.

Front display panel 28 includes a generally unshaped display opening 44. On either side of the opening are disposed the first and second side zones 50, 52 of front display panel 28. Disposed below the opening 44 is front panel bottom zone 54. Lines of weakness such as cut scorelines extend along the lines 60 and 62 respectively from the lower left and right hand corners of the display opening to the bottom closure of the carton. In addition, cut scores or other lines of weakness 66 and 68, respectively, extend from lines of weakness 60 and 62 laterally to side panels 22 and 24, at the bottom of the carton.

Figure 2:
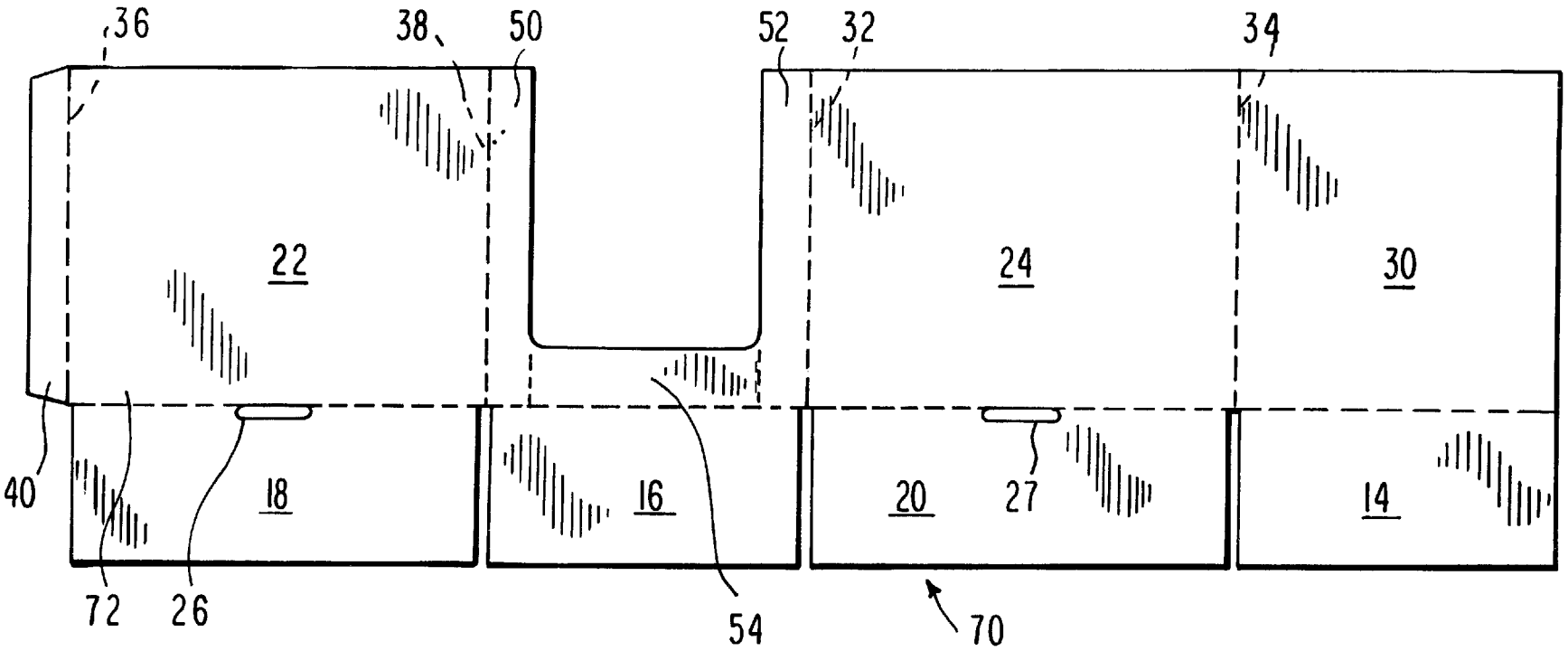
FIG. 2 is a top plan view of a carton blank which may be used to make the carton of the invention, showing the side of the blank which will form the outside of the carton.
Figure 3:
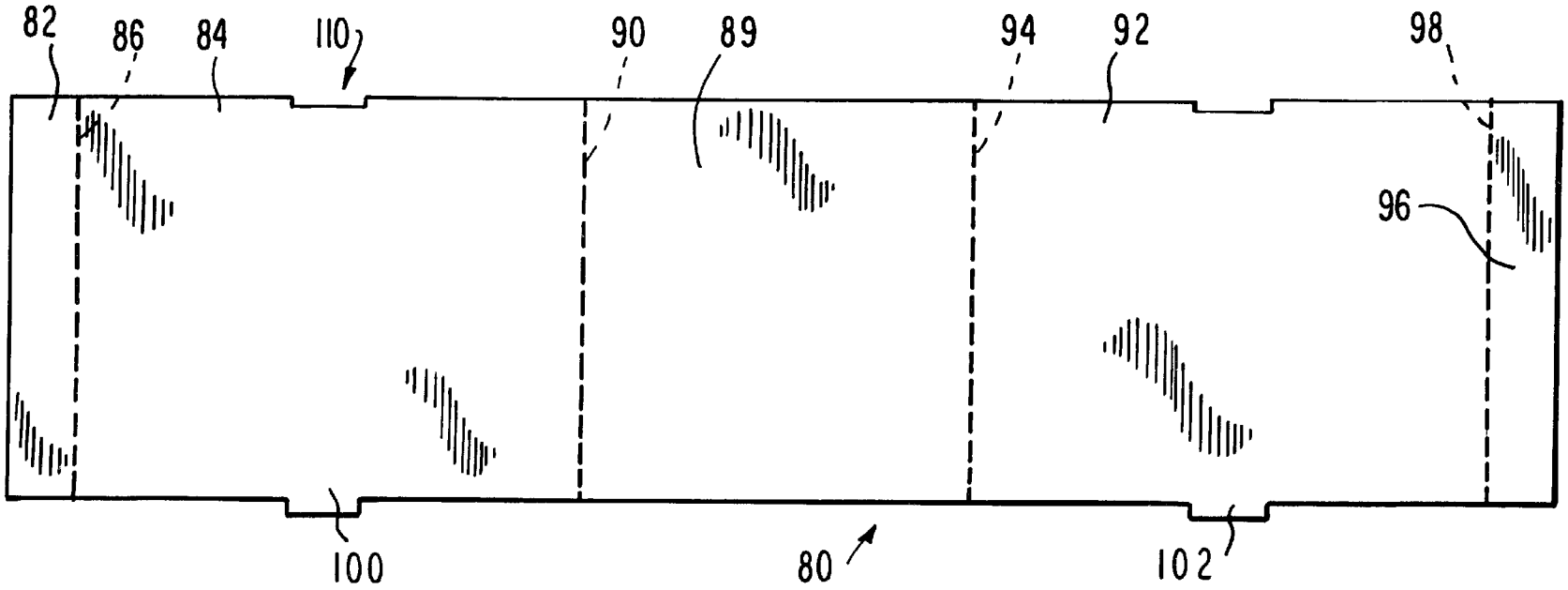
FIG. 3 is top plan view of a liner which may be used in the carton of the invention, showing the side of liner which will constitute the outside of the liner.

As seen particularly in FIG. 2, blank 70 can be used to form display carton 10. In addition to the features already described, blank 70 includes scoreline 72 which separates respectively panel 22 from flap 18, panel 28 from flap 16, panel 24 from flap 20 and panel 30 from flap 14.

Figure 4:
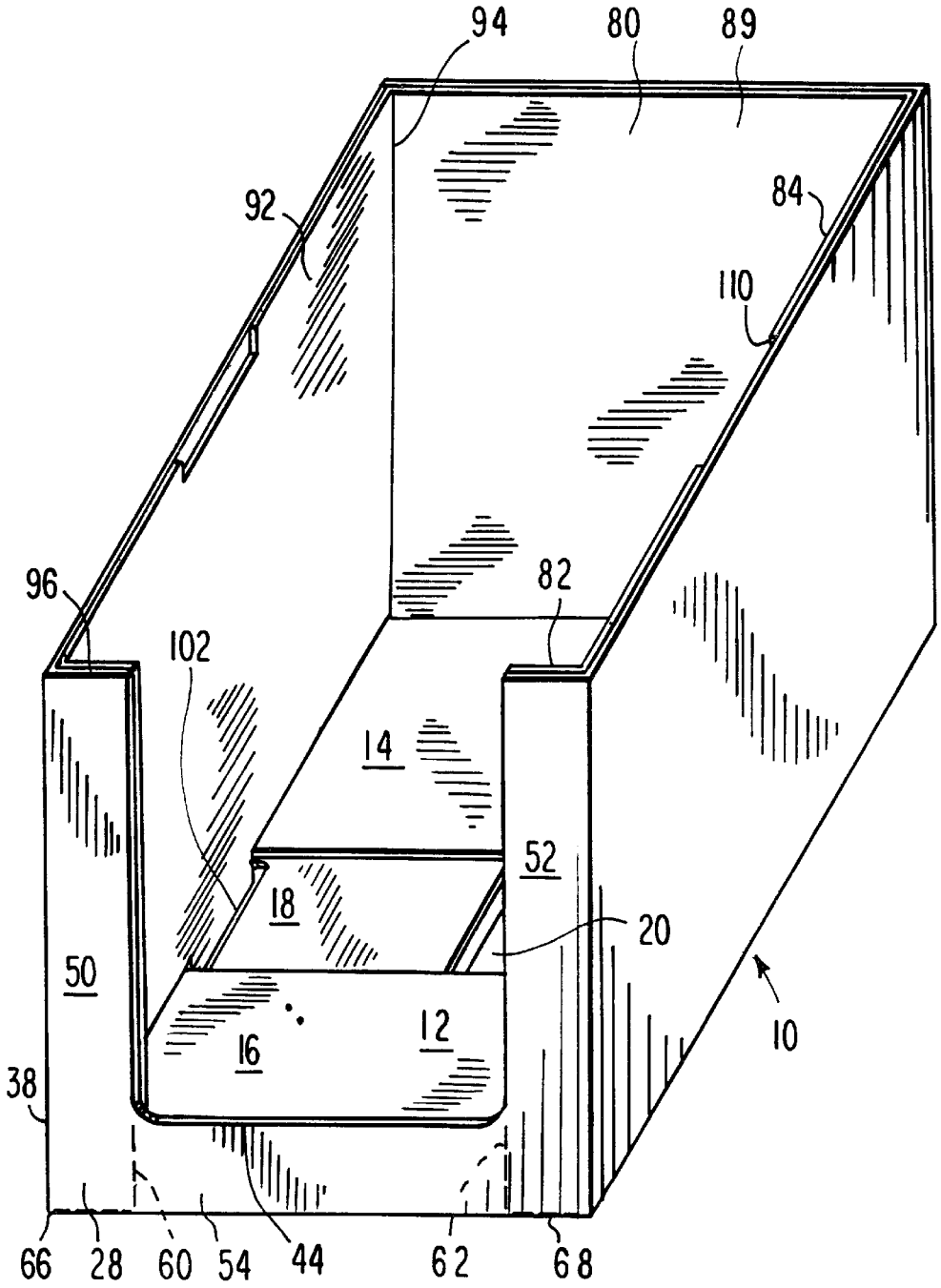
FIG. 4 is a perspective view showing an erected display and shipping carton according to the invention similar to FIG. 1, except that a liner has also been inserted.

As seen particularly in FIG. 4, shipping and display carton 10 may be lined with C-liner 80. Liner 80 includes wall 82 which corresponds substantially in dimension to display panel second side zone 52. Wall 82 is separated from liner sidewall 84 by fold line 86. Liner wall 84 corresponds substantially in dimension to second side panel 24. Rear wall 89 is separated from liner sidewall 84 by fold line 90. Wall 89 corresponds substantially in dimension to rear panel 30. Liner sidewall 92 is separated by scoreline 94 from liner wall 89. Liner wall 92 corresponds substantially in dimension to the side panel 22 of carton 10. Liner wall 96 is separated from liner wall 92 by fold line 98. Liner wall 96 corresponds substantially in dimension to that of first side zone 50 of display panel 28.

Each of liner sidewalls 84 and 92 include an extension at the bottom thereof in the form of a tab, 100, 102 respectively. The tabs are adapted to the inserted inter slots 26, 27 of flaps 18, 20 in order better to secure the liner within the carton. The tabs are borrowed from what will become an adjacent liner blank during cutting of the blank. For instance, tab 100 would be borrowed from a blank adjacent blank 80 on the side of tab 100. This would result in a cutout such as cutout 110. Cutout 110 would result from the formation of a tab in a blank formed adjacent blank 80 on the side of cutout 110.

The carton and liner are preferably made of fiberboard, although other materials may be suitable. For instance, a plastic liner may be employed in certain situations. It will be understood that where fold lines are described, any lines promoting folding of the fiberboard along the line, such as scorelines may be employed. When lines of weakness are described, lines which facilitate the tearing along those lines of the material by a human with a reasonable amount of effort, such as partially cut scorelines and perforated lines are employed.

The carton blank 70 is formed into carton 10 by squaring the various panels and adhering glue panel 40 to rear panel 30 with chemical adhesive, hot melt or other suitable adhesive. The major closure flaps may, if desired, be adhered to the minor closure flaps with chemical adhesive, hot melt or the like. Optional liner 80 may likewise be squared and then inserted into erected carton 10. Tabs 100, 102 will be received within slots 26, 27 to assist in keeping liner 80 snuggly within carton 10. Liner 80 is particularly useful where carton 10 is to be used to transport and/or display consumer products which have a high weight per unit, such as 300 oz. liquid detergent or liquid fabric softener containers. Use of the liner ensures that the carton possess as much warehouse stacking strength as would be required.

In operation, the bottles or other containers are placed with carton 10. These filled cartons may be stacked one upon the other. The cartons, stacked or not, are then shipped to a retail outlet where they are displayed. To facilitate removal of the heavy unit packages, bottom zone 54 of front panel 28 may be moved downwardly by severing lines of weakness 60, 62. This may be accomplished by simply grasping zone 54 and pulling outwardly and downwardly. This permits sliding of the heavy containers out of the display carton. Similarly, side zones 50, 52 of front display panel 28 may be minimized as potential obstacles to movement out of the carton by tearing laterally along lines of weakness 66 and 68. Zone 50, 52 will pivot on fold lines 38, 32 and further enhance the ability of the consumer to slide the large containers out of the carton.

A further advantage of the present design is that it is not necessary to reinforce the corners of the carton with special triangular structures. Moreover, the present carton, apart from the liner, is made from a single piece blank.

The slots and tab arrangements of the present invention tend to prevent "towing in" of the liner and so therefore promote the integrity of the lined carton. The slots are preferably rounded, as illustrated, since this results in better stripping of the fiberboard during slot formation. Preferably, the space between cuts on the lines of weakness are substantial (big skip) since this helps promote carton integrity. The presence of a "big skip" on the bridge of fiberboard before the first nick or cut makes the perforation pattern more robust and less likely to break inadvertently during shipping. The invention is best utilized with a half slotted container, as illustrated, although it may also be used in a fully slotted container, that is one with upper closure flaps, upper slots in closure flaps and upper tabs in the liner.

Preferably the tabs 102, 100 are dimensioned so as to rest firmly on the surface which supports the bottom of the carton.

The present design provides the carton with preferably three panels, for compressive strength, rather than having flaps supporting the sides of the carton.

It should be understood of course that the specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A display carton comprising:

a) one or more flaps forming a bottom closure, b) at least two carton wall side panels extending upwardly from said bottom closure on opposite sides of said bottom closure, c) at least one display panel extending upwardly from said bottom closure between said carton wall side panels and separated from at least one of said carton wall side panels by a fold line and integral therewith, said display panel having a display opening which is spaced from said bottom closure by a lower zone of said panel and from said at least two carton wall side panels by first and second side zones of said panel, said display panel including first lines of weakness for extending said display opening toward said bottom closure, d) liner having at least two liner walls adjacent said at least two carton wall panels, e) said liner including at least one extension and said bottom closure including at least one aperture adapted to receive said extension, f) said extension being a first tab and said aperture being a first slot, g) said first tab extending from one said liner wall adjacent said first side panel and a second tab extending from a second said liner wall adjacent said second side panel, said bottom closure including said first slot receiving said first tab and said bottom closure further comprising a second slot receiving said second tab, h) said extension extending from a liner wall and said liner wall further including a cut out of dimensions corresponding to the extension.

2. The display carton according to claim 1 wherein said display panel further including additional lines of weakness for extending said display opening toward at least one of said first and second side panels.

3. The display carton according to claim 1 wherein said wall panels further comprising a rear panel extending upwardly from said bottom closure between said first and second side panels and opposite said display panel.

4. The display carton according to claim 3 wherein additional lines of weakness permit extension of said display opening to said first and second side panels by folding or removal of said first and second side zones of said display panel.

5. The display carton according to claim 4 wherein said additional lines of weakness separate said first and second side zones of said display panel from said bottom closure.

6. The display carton according to claim 1 wherein said liner has at least three liner walls adjacent said at least two carton wall panels.

7. The display carton according to claim 6 wherein said liner includes a further liner wall adjacent at least a portion of said display panel.

8. The display carton according to claim 1 further comprising a rear panel extending upwardly from said bottom closure.

9. The display carton according to claim 1 wherein said display panel is integral with each of said first and second side panels and is separated from each by a fold line.

* * * * *